US011230117B2

(12) United States Patent
Stoeckle et al.

(10) Patent No.: US 11,230,117 B2
(45) Date of Patent: Jan. 25, 2022

(54) METHOD FOR ADJUSTING A SETUP FOR AN ENCODER FOR PRINTING TO A RECORDING MEDIUM OF UNKNOWN THICKNESS WITH A MULTI-ROW INKJET PRINT HEAD IN A PRINTING SYSTEM

(71) Applicant: Canon Production Printing Holding B.V., Venlo (NL)

(72) Inventors: Ulrich Stoeckle, Munich (DE); Christoph Rummelsberger, Ismaning (DE); Florian Hitzlsperger, Poing (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/999,685

(22) Filed: Aug. 21, 2020

(65) Prior Publication Data

US 2021/0053363 A1 Feb. 25, 2021

(30) Foreign Application Priority Data

Aug. 21, 2019 (DE) ..... 102019122476.4

(51) Int. Cl.
*B41J 2/21* (2006.01)
*B41J 11/00* (2006.01)
*B41J 29/38* (2006.01)

(52) U.S. Cl.
CPC ..... *B41J 2/2132* (2013.01); *B41J 11/008* (2013.01); *B41J 29/38* (2013.01)

(58) Field of Classification Search
CPC ..... B41J 2/2132; B41J 11/008; B41J 29/38; B41J 11/0035; B41J 2/2135; B41J 2/2146; B41J 29/393; B41J 2029/3935
See application file for complete search history.

(56) References Cited

U.S. PATENT DOCUMENTS

| | | | | |
|---|---|---|---|---|
| 5,297,017 A * | 3/1994 | Haselby | ..... | B41J 2/2135 346/139 R |
| 6,106,095 A * | 8/2000 | Jackson | ..... | B41J 2/2135 347/19 |
| 10,406,840 B2 | 9/2019 | Zollner et al. | | |
| 2012/0219342 A1 | 8/2012 | Peter | | |

FOREIGN PATENT DOCUMENTS

| | | | | |
|---|---|---|---|---|
| DE | 10 2010 016 857 A1 | 11/2011 | | |
| DE | 10 2011 017 209 A1 | 8/2012 | | |
| DE | 10 2017 114 470 A1 | 1/2019 | | |
| EP | 0931671 A2 * | 7/1999 | ..... | B41J 11/008 |

OTHER PUBLICATIONS

German Patent Office Search Report dated May 13, 2020, for Application 10 2019 122 476.4.

* cited by examiner

*Primary Examiner* — Julian D Huffman
(74) *Attorney, Agent, or Firm* — Schiff Hardin LLP

(57) ABSTRACT

In a method for adjusting a setup for an encoder for printing to a recording medium of unknown thickness with a multi-row inkjet print head in a printing system, a continuous test line is printed onto the recording medium, transversal to a feed direction of said recording medium, a varied width of the test line is measured, and the adjustment of the setup is modified to minimize the width of the test line.

15 Claims, 6 Drawing Sheets

METHOD FOR ADJUSTING A SETUP FOR AN ENCODER FOR PRINTING TO A RECORDING MEDIUM OF UNKNOWN THICKNESS WITH A MULTI-ROW INKJET PRINT HEAD IN A PRINTING SYSTEM

CROSS REFERENCE TO RELATED APPLICATIONS

This patent application claims priority to German Patent Application No. 102019122476.4, filed Aug. 21, 2019, which is incorporated herein by reference in its entirety.

BACKGROUND

Field

The disclosure relates to a method for adjusting a setup for an encoder for printing to a recording medium of unknown thickness with a multi-row inkjet print head in a printing system.

Related Art

An adaptation of the setup for the encoder of the printing system is always also necessary in the event of a recording medium change. In particular in the event of paper as a recording medium, no reliable conclusion of the precise thickness can be drawn from the specifications, which are typically based on the average grammage, since said thickness depends on a multitude of fiber parameters and also may vary depending on type and charge given the same grammage. In the event that the setup of the encoder does not match the paper thickness, the timing of the printing process is incorrectly relayed to the print head or print heads of the printing system, such that the line clock is wrong upon printing, which negatively affects the print quality. Under the circumstances, the correct thickness of the recording medium is also required for correct adjustment of the web tension.

The functionality of the encoder, and the correlation with the timing of the printing process, is described in detail in DE 10 2017 114 470 A1, which deals with the improvement of the print quality via reduction or compensation of fluctuations of the encoder signal.

To adjust a setup for an encoder in a printing system, the paper thickness is sometimes measured with a measuring device and entered into a setup or configuration routine. This requires a manual measurement and entry. DE 10 2010 016 857 A1 describes a corresponding measuring arrangement and a method for determining the thickness of a recording medium.

However, the need exists to enable roll changes in printing systems as needed, in particular in an automated manner, optimally without loss of productivity.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
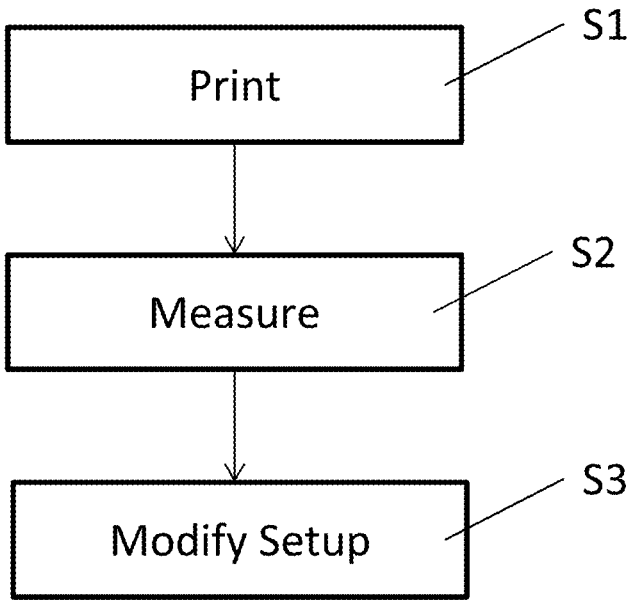

FIG. 1 a flowchart of a method, according to an exemplary embodiment, for adjusting a setup for an encoder for printing to a recording medium of unknown thickness with a multi-row inkjet print head in a printing systems.

Figure 2:
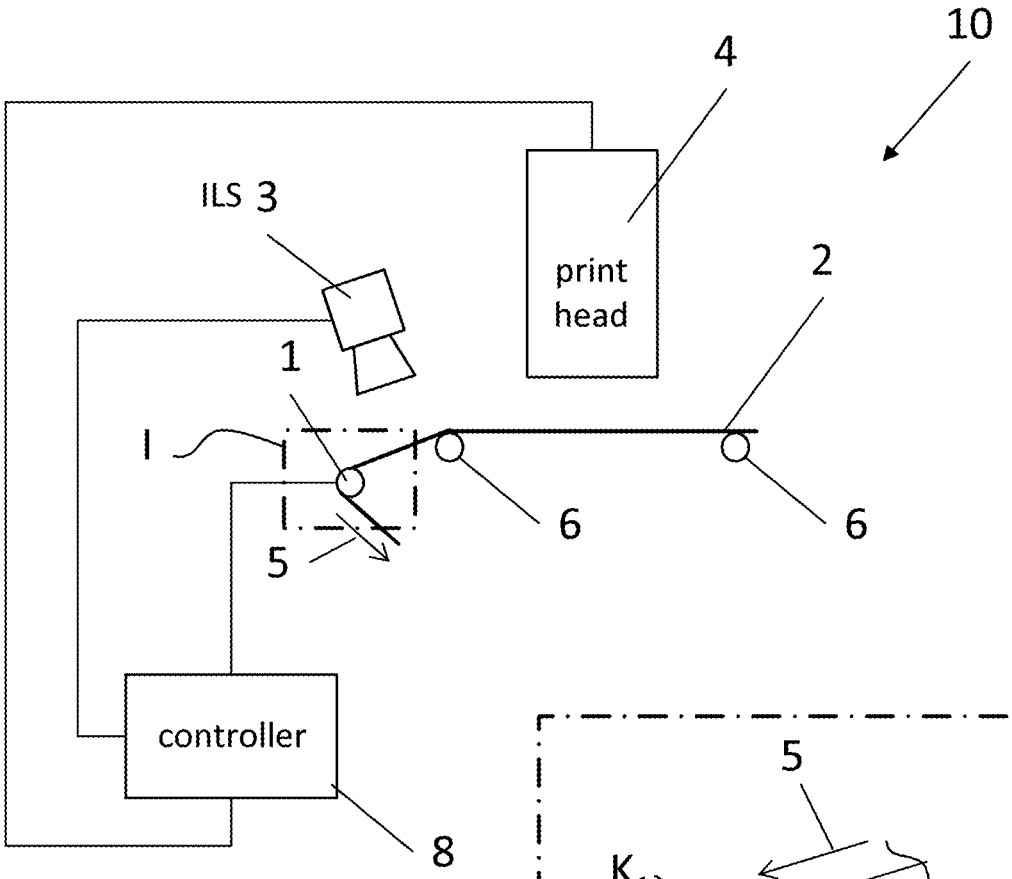

FIG. 2 a printing system according to an exemplary embodiment.

Figure 3:
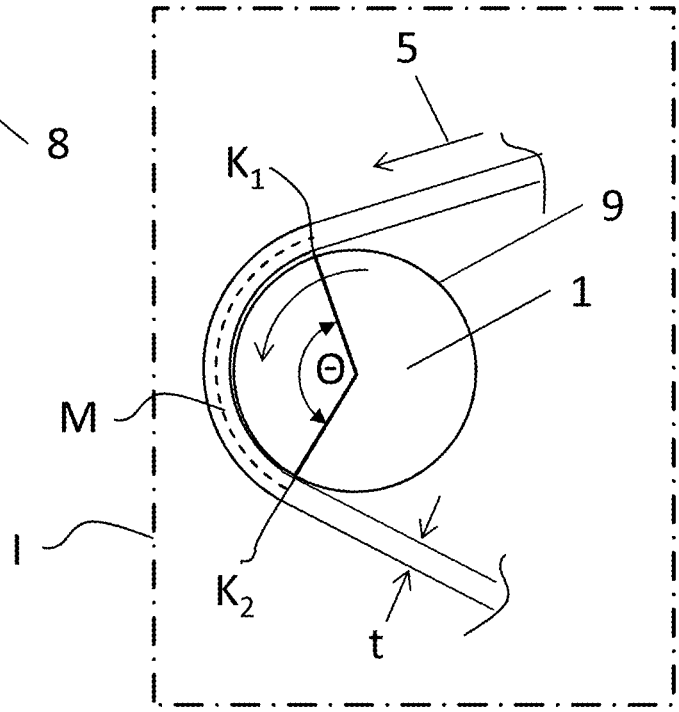

FIG. 3 an enlargement of the region I marked with a dash-dot line in FIG. 2.

Figure 4:
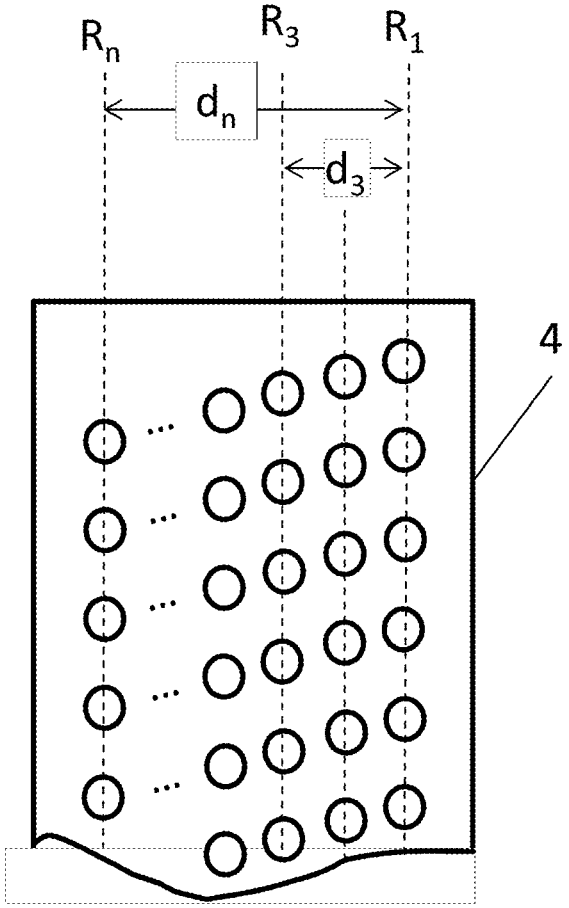

FIG. 4 a plan view of a nozzle plate of a print head according to an exemplary embodiment.

Figure 5:
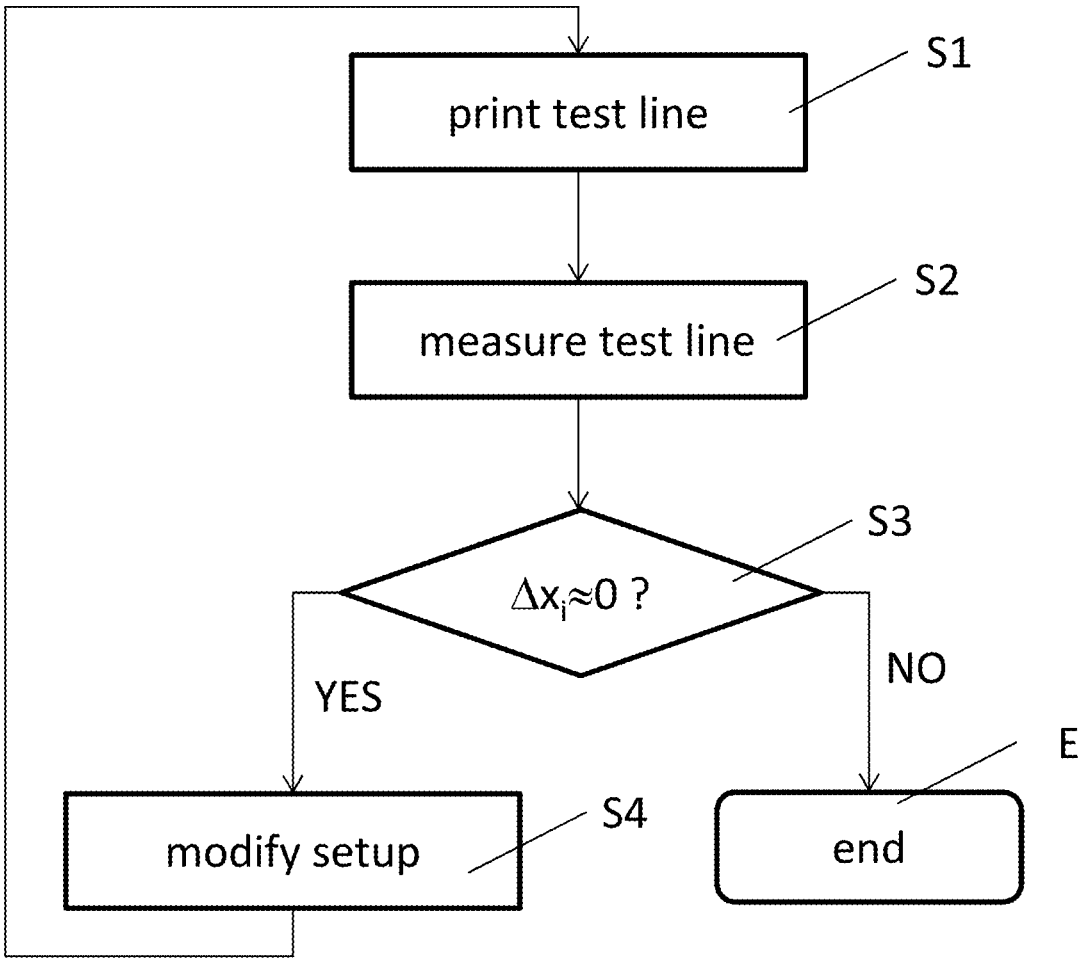

FIG. 5 a flowchart of a method for adjusting a setup according to an exemplary embodiment.

Figure 6A:
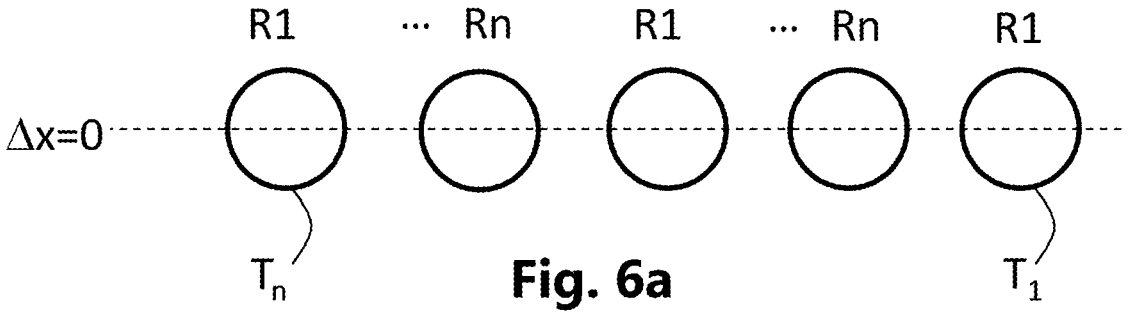

FIG. 6*a* a schematic depiction of pixels of a test line printed with correct setup of the encoder according to an exemplary embodiment.

Figure 6B:
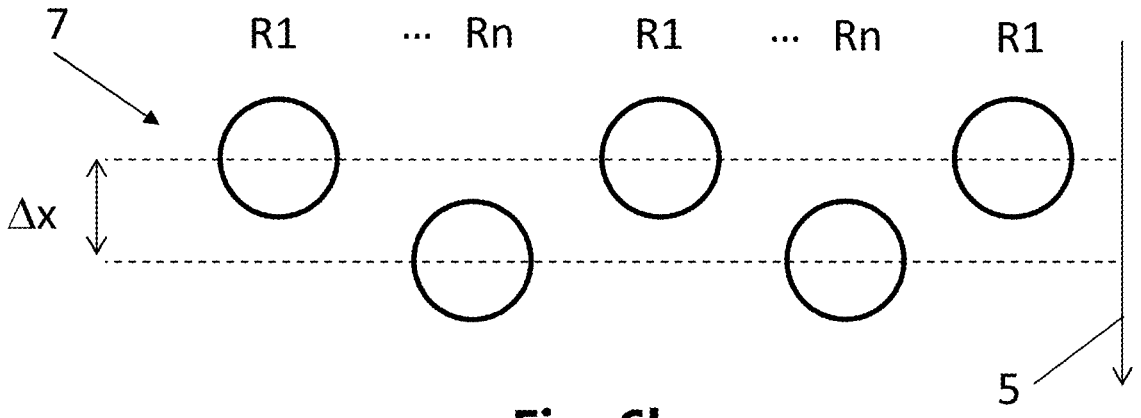

FIG. 6*b* schematic depiction of pixels of a test line printed with the setup according to FIG. 5 on a different recording medium with deviating thickness.

Figure 7A:
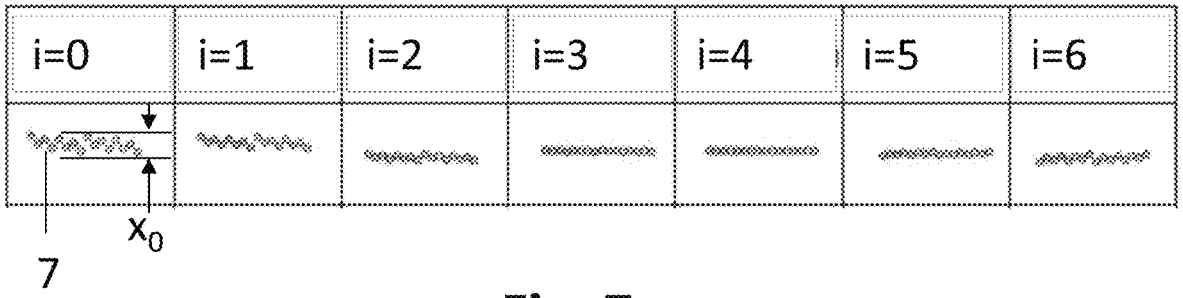

FIG. 7*a* a schematic depiction of a test line for a plurality of passes of the method according to FIG. 4.

Figure 7B:
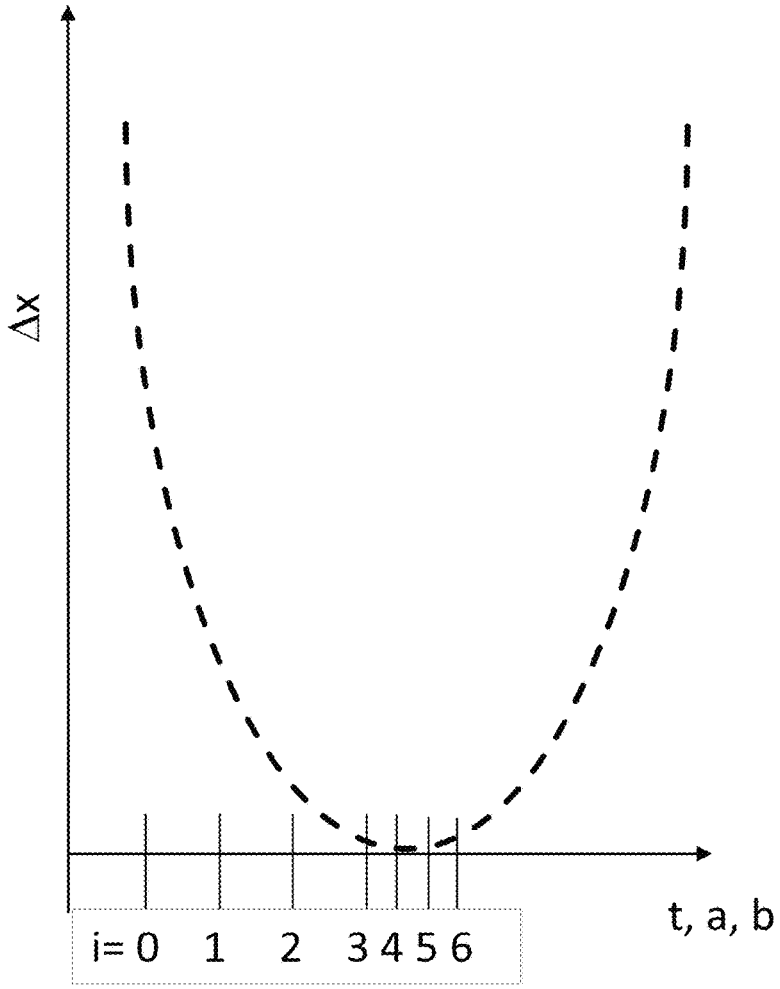

FIG. 7*b* a qualitative diagram of a curve of the variation of the width of the test line over the thickness or encoder step width or number of cycle steps corresponding to the row pitch of the inkjet head, according to an exemplary embodiment, the thickness or encoder step width or number being adjusted in the setup.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

With this as background, the present disclosure is based on the object of providing an improved method for adjusting a setup for an encoder for printing to a recording medium of unknown thickness with a multi-row inkjet print head in a printing system.

The disclosure relates to a method for adjusting a setup for an encoder for printing to a recording medium of unknown thickness with a multi-row inkjet print head in a printing system, having the steps: print a continuous test line onto the recording medium, transversal to a feed direction of said recording medium; measure a varied width of the test line; and modify the adjustment of the setup to minimize the width of the test line.

The realization forming the basis of the disclosure is that a varied width of a test line can be detected given an incorrect setup of the encoder.

The idea forming the basis of the disclosure is now to perform a minimization of the width of the test line. This may be performed experimentally or computationally using the measurement of the test line.

For example, what is known as an ILS (In-Line Scanning) system, which is often integrated into a printing system anyway, may be used to measure the width. In this way, the method according to the disclosure can advantageously be implemented directly at the printing system and without an additional measuring device. In particular, even inline measurements are possible, such that the adjustment of the setup may likewise be performed directly in running operation of the printing system in the event of an automated roll change. The setup may thus advantageously be automatically adapted to a new thickness of the recording medium.

According to one embodiment, the modification may be performed with a predetermined step width, wherein the steps of printing and measuring may subsequently be repeated. In the event of a measured reduced width of the test line, the step of the modification is repeated, and the steps of the printing and measuring are performed again from the start. The method thus repeats until the width of the test line no longer reduces or increases again. If a minimum of the width is reached or identified, the adjustment chosen given the minimum is retained. In this way, an adjustment of the setup that is optimal for the unknown thickness of the new recording medium is advantageously achieved without additional system or measurement engineering. If desired, the minimization may also be continued further iteratively, in that the step size is reduced and the adjustment in the opposite direction is varied until a minimum is reached again. This may obviously be continued with ever smaller step widths up to a desired termination criterion or up to the limit of the measurement capability.

According to one embodiment, the modification of the setup includes an entry of a new assumed thickness of the recording medium. That means that the newly assumed thickness serves as a basis for the timing of the printing process. The setup is thereby adapted via entry of the newly assumed thickness similarly to ask if a measurement of the thickness of said recording medium had previously been performed. Whether the new assumed value is true is subsequently checked again using a test line. As an alternative or in addition to an assumed new thickness, a new encoder step width correlating thereto based on the wrap of the encoder roller may also be entered. Furthermore, the entry of a new number of encoder steps corresponding to a row pitch of the inkjet print head is alternatively or additionally possible. For this, a maximum row pitch of a first row to a last row of the inkjet head is preferably used that therewith yields the greatest deviation, and thus the most precise adjustment. Since the thickness of the recording medium correlates with the encoder step width or, respectively, to the number of encoder steps corresponding to a row pitch of the inkjet print head, these variables may be similarly used given corresponding conversion for adaptation of the setup.

According to one embodiment, the measurement includes the identification of an absolute variation of the width of the test line. In this way, it can be established whether a displacement of dots of the test line in the feed direction or counter to the feed direction is present. In this way, the modification of the setup may be specifically performed to compensate for the displacement, meaning a parameter variation directly in the correct direction.

According to one embodiment, the modification S3 includes a calculation of a new encoder step width for the unknown thickness of the recording medium using the measured absolute variation of the width of the test line, as well as of an encoder step width known relative to a known thickness of another recording medium, and of a known row pitch of the inkjet print head. In particular, for this purpose the maximum row pitch of a first row to a last row of the inkjet print head is used. A very precise estimation of the new encoder step width thus results which may serve as a basis for the adaptation of the setup and be determined in a simple manner.

According to one development, the modification of the adjustment of the setup also includes an entry of the new encoder step width and/or of a number of encoder steps corresponding to the row pitch of the inkjet print head, in particular the maximum row pitch of a first row to a last row. In this way, a new encoder step width matching the new recording medium may advantageously be entered without iterative steps directly after only one measurement, and the regular printing process may subsequently be started.

According to one development, the new encoder step width is calculated from the difference of the known encoder step width, as a minuend, and the quotient of the measured absolute variation of the width of the test line and a number of encoder steps, said number corresponding to the row pitch of the inkjet head, as a subtrahend. For this, the variation of the width of the test line as a product of the variation of the respective encoder step width, depending on the respective thicknesses, is multiplied with the number of encoder steps corresponding to the row pitch is used as a starting point and resolved according to the new encoder step width. The new encoder step width can accordingly be formulaically represented as $$a=a0-(\Delta x/b),$$

with a as an encoder step width, a0 as an encoder step width known relative to a known thickness of a different recording medium, Δx as an absolute variation of the width of the test line, and b as a number of encoder steps corresponding to a row pitch of the inkjet head.

According to one embodiment, the modification S3 includes a calculation of the new, unknown thickness of the recording medium using the measured absolute variation of the width of the test line, as well as an encoder step width known relative to a known thickness of another recording medium and a known row pitch of the inkjet print head. A very precise estimate of the new thickness of the recording medium thus results which may serve as a basis for the adaptation of the setup and be determined in a simple manner.

According to one development, the modification of the adjustment of the setup also includes an entry of the new thickness of the recording medium. In this way, a new thickness matching the new recording medium may advantageously be entered without iterative steps, and the regular printing process may subsequently be started.

According to a further embodiment, the new paper thickness is calculated from the difference of the known paper thickness as a minuend and a subsequently explained quotient as a subtrahend. The quotient is calculated from the product of the measured absolute variation of the width of the test line with a number of clock cycles as a dividend, said number corresponding to the full revolution of the encoder, and the product of a number of cycle steps, with the circle constant π as divisor, said number corresponding to the row pitch of the inkjet head. The new thickness of the recording medium can accordingly be formulaically represented as $$t=t0-(\Delta x*n)/(b*\pi),$$

with t as a new thickness of the recording medium, t0 as a known thickness of the other recording medium, Δx as a measured absolute variation of the width of the test line, n as a number of encoder steps corresponding to the full revolution of the encoder, b as a number of cycle steps corresponding to the row pitch of the inkjet head, and π as the circle constant.

The above embodiments and developments can be arbitrarily combined with one another insofar as is reasonable. Further possible embodiments, developments, and implementations of the disclosure also encompass combinations of features of the disclosure describe in the preceding or in the following, with regard to the exemplary embodiments, that were not explicitly cited. In particular, the person skilled in the art will thereby also add individual aspects as improvements or supplements to the respective basic form of the present disclosure.

Accompanying Figures of the drawings should impart a further understanding of the embodiments of the disclosure. They illustrate embodiments and, in conjunction with the specification, serve for the declaration of principles and concepts of the disclosure. Other embodiments and many of the cited advantages result with regard to the drawings. The elements of the drawings are not necessary shown to scale relative to one another.

In Figures of the drawings, elements, features, and components that are identical, functionally identical, or have identical effect are respectively provided with the same reference characters, insofar as is not stated otherwise.

FIG. 1 shows a flow diagram of a method for adjusting a setup for an encoder 1 for printing to a recording medium 2 of unknown thickness t with a multi-row inkjet print head 4 in a printing system 10.

The method has the steps of printing S1 on the recording medium a continuous test line 7 transversal to a feed direction 5 of said recording medium 2; measuring S2 an altered width Δx of the test line 7; and modifying S3 the adjustment of the setup to minimize the width Δx of the test line 7.

Given a change of the recording medium, an altered thickness of said recording medium can thus be detected using an altered width of a test line, which allows a conclusion of an incorrect setup of the encoder, meaning a setup that does not match the thickness of the recording medium.

A matching adjustment of the setup is therefore found via a minimization of the width x of the test line 7 (see FIGS. 6*a* and 6*b*). This may be performed experimentally or computationally. In particular, an automated adaptation of the setup to a new thickness t of the recording medium 2 is enabled via the minimization.

FIG. 2 shows a schematic depiction of a segment of a printing system 10.

The printing system 10 is configured to execute the method according to FIG. 1 and has at least one print head 4, at least one encoder 1, and an in-line scanning (ILS) system 3. Deflection rollers 6 are also provided for conveying the recording medium 2 through the printing system and aligning with respect to the print head 4.

The ILS system 3 is arranged after the print head 4, as viewed in the transport direction of the recording medium 2, and configured to check the print image. For example, for this purpose it may be a line camera. In the event of a test line 7, a variation of the width Δx of the test line 7 may be checked by means of the ILS system 3. For this, the ILS system 3 relays a detected test line width x to a controller 8 which performs a comparison with a nominal value and thus establishes a variation Δx of the width. The encoder 1 also relays a number of measured clock cycles to the controller 8.

The encoder 1 is designed as a roller which is wrapped by the recording medium. The number of clock cycles that are measured by means of the encoder 1 per feed length therefore also depends on the thickness t of the recording medium 2 that is used. Given a thicker paper, an outer circumferential velocity thus corresponds to fewer clock cycles than given a thinner paper. In other words, the outer circumferential velocity increases with the thickness of the recording medium given the same encoder timing.

The controller is also configured to control the print head 4, which is performed on the basis of the timing provided by the encoder. However, if the thickness of the recording medium changes, this timing is no longer correct.

To change the timing, a thickness t of the recording medium or a step width a corresponding to a timing may be adjusted with a setup for the encoder 1. The setup can be stored in the controller 8. To minimize the width Δx, the controller 8 is thus configured to perform a parameter modification, for example a modification of the set thickness t or a modification of the set encoder step width a, in the event of the measurement of a variation of the width Δx of the test line 7. For example, the modification may be input manually by means of a human/machine interface (not depicted here for better clarity) or, if applicable, also automatically on the basis of an automatic evaluation of the measured variation of the width Δx of the test line 7. In an exemplary embodiment, the controller 8 includes processor circuitry that is configured to perform one or more functions and/or operations of the controller 8.

FIG. 3 shows an enlargement of the dash-dot region I from FIG. 2. Depicted therein is a side view of the encoder roller 1, partially wrapped by the recording medium 2. The adjustment angle Θ between the contact point $K_1$ at which the recording medium 2 first comes into contact with the encoder roller 1 and the second contact point $K_2$ at which the recording medium 2 leaves the encoder roller 1 is greater than 90° in FIG. 3. The wrap angle is typically between 5° and 90°.

The encoder 1 is configured to provide a base timing to determine the line signal for the activation of the nozzles of the print head 4. As depicted in FIG. 3, the encoder 1 comprises a pickup roller 9 that is driven by the recording medium 2 moving in the feed direction and that moves slip-free with the recording medium 2. One revolution of the pickup roller 9 thus corresponds to a defined path of the recording medium 2 which, however, depends on the thickness t of the recording medium 2.

For example, the encoder 1 may have a disc provided with slits that is located between at least one first light-emitting diode and at least one first photodetector, which here is not shown for better clarity. For example, the encoder may be a rotary encoder as is described in detail in DE 102017114470 A1.

The line density (the number of lines to be printed within a defined distance on the recording medium 2) depends on the dot resolution of the print head 4. Given an example resolution R of 1200 dpi, the distance between two printed lines of a print image corresponds to approximately 21.2 μm. Given a correct setup, a line signal provided for the print head 4 by means of the controller 8 is prepared with a sequence of line clock signals for the individual nozzle rows $R_1$ through $R_n$ of a defined print head, such that the distance between two line clock signals corresponds exactly to a path of the recording medium 2 of 21.2 μm. This timing applies to each print nozzle row R1 . . . Rn of the print head, wherein the timings of the individual rows are, however, displaced by a time offset or, respectively, to their row pitch d. For example, the first nozzle row $R_1$ is thus taken as a reference (any other nozzle row $R_n$ may be chosen for this). All others of these nozzle rows $R_x$ ($x \neq 1$) have a pitch $d_x$ relative to the first nozzle row $R_1$ so that the corresponding line clock signal for the corresponding nozzle row $R_x$ is time-shifted relative to the line clock signal of the first nozzle row $R_1$.

This line clock signal is determined on the basis of the base clock generated by the encoder 1, which correlates directly with the feed velocity 5 of the recording medium 2, more precisely speaking with the velocity of a center line M—drawn as dashes in FIG. 3—of the recording medium 2. This yields the test line 7 depicted in FIG. 6*a*, printed on the recording medium 2, and generated from droplets $T_1$ through $T_n$. All droplets $T_1$ through $T_n$ represented as a circle and printed by the different nozzle rows $R_1$ through $R_n$ thereby lie in a line.

However, if the feed velocity 5 deviates due to an altered thickness t, and thus a circumferential velocity of the recording medium 2 that is altered at the encoder 1, the line clock and most of all the time offset corresponding to the row pitch d between a first nozzle row $R_1$ and another (in particular last) nozzle row of a print head s no longer match said feed velocity 5, which is measurable using an offset, in the feed direction of the recording medium 2, of the individual droplets of a test line 7 that were output from different print nozzle rows of the inkjet print head 4. The difference can be most clearly detected using the pitch of ink droplets of the test line 7 that were printed with a first print nozzle row $R_1$ and a last print nozzle row $R_n$ of the print head 4; see FIG. 6*b*.

If this offset, and therefore the width x of the test line 7, is minimized via a variation of the timing parameter, this leads to an automatic adaptation of the setup to the new thickness t of the recording medium 2.

There are multiple ways and possibilities for minimizing the width Δx of the test line 7.

FIG. 5 shows a flow diagram of a method for adjusting a setup according to one embodiment.

The minimization of the width x of the printed test line 7 is hereby performed experimentally. First, in step S1 a test line 7 is printed by at least two different nozzle rows $R_n$. Next, in step S2 the width x of the test line 7 and/or the variation of the width Δx of the test line 7 is determined. In a first pass of step S3, a check is made as to whether the width $x_0$ of the test line 7 exceeds a defined threshold $x_s$. If this is so, in step S4 the setup (for example the line clock signal for the individual nozzle rows) is performed with a predetermined step width. Steps S1 and S2 are repeated. For this, in step S2 the first test line width $x_0$ from the previous (here first) pass is subtracted from the second test line width $x_1$ from the current (here second) pass and stored as the variation of the test line width $\Delta x_1$. The change of the test line width $\Delta x_0$ thus corresponds to the initially measured test line width $x_0$, whereas the variation of the test line width after the n-th pass is calculated as follows: $\Delta x_n = x_{n-1} - x_n$, wherein the indices represent the number of elapsed repetitions of steps S1 through S4. After the check in step S3, the corresponding parameters are modified in step S4. Steps S1 through S4 are subsequently repeated until a termination criterion of a sufficient approximation to a minimum width (here $x_4$) or a minimization of the variation Δx of the width to approximately 0 has been reached. Upon satisfying the termination criterion, the end E of the method is reached and the adjustment of the setup corresponding to the minimum width of the test line 7 is adopted.

To modify S4 the setup, different parameters may be varied that, however, correlate to one another. For example, an entry of a newly assumed thickness t of the recording medium 2 may be performed. In further embodiments, a new encoder step width a may also be entered which, however, is due to the altered thickness t, among other things. An entry of a new number of encoder steps b, corresponding to a row pitch d of the inkjet print head, would be possible to change the setup, but which is likewise due to the encoder step width or the altered thickness t. In particular, in order to minimize a measurement error, the maximum row pitch d of a first row from a last row may be used, and the number of encoder steps corresponding thereto may be entered, and from this for example the new encoder step width a may be derived which in turn allows the new thickness t of the recording medium to be concluded.

FIG. 6*a* shows a schematic depiction of pixels of a test line 7 printed with a correct setup of the encoder.

The pixels were printed by a first row R1 and a last row Rn of the print head and lie exactly on a common line. An offset Δx is thus 0.

FIG. 6*b* shows a schematic depiction of pixels of a test line 7 printed with the setup according to FIG. 5*a* on a different recording medium having deviating thickness t.

The pixels were printed by a first row R1 and a last row Rn of the print head 4 and are offset relative to one another. If all rows R1 through Rn are included in the consideration, a sawtooth curve of the test line 7 arises. The alteration of the test line width $\Delta x_n$ can therefore be measured not only in terms of magnitude but also in its direction, i.e. whether it is present in or counter to the feed direction. The measurement S2 thus includes the identification of an absolute variation of the width Δx of the test line 7.

FIG. 7*a* shows a schematic depiction of a test line for multiple passes of the method according to FIG. 5.

As an initial situation, the test line 7 depicted to the far left in FIG. 7*a* has a large test line width $x_0$ before a minimization, meaning without a pass of the method (i=0), for example after a swapping of the recording medium with modified thickness. The width $x_{1,2,3}$ reduces continuously with increasing variation of the parameter in a first pass (i=1), second pass (i=2), and third pass (i=3). Given an already strong approximation to the termination criterion, the step width may be reduced for subsequent passes. A minimum is hereby reached with the fourth pass i=4. In the subsequent passes i=5 and i=6, the test line width $x_5$ and $x_6$ increases again (thus also the alteration of the test line width $\Delta x_5$ and $\Delta x_6$), such that these passes may be discarded, and the corresponding adjustments of the setup given i=4 may be retained, and the method may be ended.

FIG. 7*b* shows a qualitative diagram of a curve of the variation of the width Δx of the test line 7 over: the thickness t of the recording medium 2 or encoder step width a or a number of clock steps b corresponding to the row pitch of the inkjet head, which thickness t or encoder step width a or number of clocks steps b was adjusted in the setup. The calculation of these parameters is explained in detail in the following pages.

The variations of the width Δx are schematically apparent in a parabolic curve which decreases from the left side, starting from i=0, to a minimum or vertex point at the adjustment corresponding to i=4, and given variation continuing beyond that increases again at i=5 and i=6. The adjustment at i=4 should thus be adopted as a new adjustment of the setup.

However, the minimization may also be performed computationally using a single measurement of the altered width of the test line. For this, the maximum row pitch $d_n$ of a first row R1 relative to a last row Rn of the inkjet print head 4 may serve as a reference length.

The maximum row pitch $d_n$ shown here of a first row R1 to a last row Rn of the inkjet print head 4 is measurable or known. With the known resolution R of the print head 4 and the known line clock f of the line encoder per pixel, a number b of clock steps of the line clock, said number corresponding to this pitch d, can be derived, for which the quotient is calculated from the difference of the pitch d and the theoretical or known encoder step width a0 predetermined by the resolution R and clock count f.

$$b=d_n/a0$$

$$a0=1/(R*f)$$

For example, the maximum row pitch $d_n$ results in $d_n$=32.174 mm. Given a resolution of 1200 dpi (dots per inch; 1 inch=25.4 mm) and a clock count of 6 clocks per row, $$b=32.174\text{ mm}/(25.4\text{ mm}/(1200*6)=9120$$

results, and $$a0=25.4\text{ mm}/(1200*6)=3.5277\ \mu\text{m}$$

The actual encoder step width a results from the theoretically resulting contour of the neutral center line M of the recording medium 2 and the sum of the encoder steps n for an entire revolution of the encoder roller. The radius r of the encoder roller 9 and the half-thickness t of the recording medium 2 (position of the neutral fibers) are accordingly multiplied by 2π and divided by the number of encoder steps n of one revolution.

$$a=(2\pi*(r*t/2))/n$$

If a variation of the width Δx of the test line 7 is then further assumed as a difference of the theoretical or known encoder step width a0 from the actual encoder step width a, multiplied by the number of clock steps of the line clock corresponding to the pitch d, $$\Delta x=(a0-a)*b,$$

the new encoder step width or the new thickness t can thus be resolved:

$$a=a0-(\Delta x/b)$$

with a as encoder step width, a0 as a known encoder step width, Δx as an absolute variation of the width of the test line, and b as a number of encoder steps corresponding to a row pitch of the inkjet head, or $$t=t0-(\Delta x*n)/(b*\pi),$$

with t as a new thickness of the recording medium, t0 as a known thickness of the other recording medium, Δx as a measured absolute variation of the width of the test line, n as a number of encoder steps corresponding to the full revolution of the encoder, b as a number of clock steps corresponding to the line pitch of the inkjet head, and π as the circle constant.

The modification S4 may thus include a calculation of a new encoder step width a for the unknown thickness t of the recording medium 2 or a direct calculation of the new thickness t of the recording medium. The modification S3 of the adjustment of the setup accordingly also includes an entry of the new encoder step width a or of the new thickness t of the recording medium 2 into the setup.

Although the present disclosure has been described entirely in the preceding using preferred exemplary embodiments, it is not limited thereto, but rather can be modified in a multitude of ways.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 encoder
2 recording medium
3 in-line scanning (ILS) system
4 inkjet print head
5 feed velocity
6 deflection roller
7 test line
8 controller
9 encoder roller
10 printing system
a encoder step width
a0 known encoder step width
b number of encoder steps
d row pitch
E end
R resolution
R1-Rn rows
S1-S4 steps
t thickness of the recording medium
t0 known thickness
x width of the test line
Δx variation of the width of the test line

The invention claimed is:

1. A method for adjusting a setup for an encoder for printing to a recording medium of unknown thickness with a multi-row inkjet print head in a printing system, the method comprising:

printing a continuous test line onto the recording medium, transversal to a feed direction of said recording medium;

measuring a variation in a width of the test line; and modifying an adjustment of the setup, based on the measurement of the variation of the width, to minimize the variation of the width of the test line.

2. The method according to claim 1, wherein the modifying the adjustment of the setup is performed with a predetermined encoder step width, the method further comprising:

subsequent to the modifying operation, repeating the printing operation to print another continuous test line and the measuring operation to measure a variation in a width of the other test line; and in response to the variation in the width of the other test line being less than the variation in the width of test line, repeating the modifying, the printing, and the measuring operations.

3. The method according to claim 2, wherein the modifying of the adjustment of the setup includes setting: a new assumed thickness of the recording medium, a new encoder step width, and/or a new number of encoder steps corresponding to a row pitch of the inkjet print head.

4. The method according to claim 1, wherein the measuring includes identifying an absolute variation of the width of the test line.

5. The method according to claim 4, wherein the modifying comprising:

calculating a new encoder step width for the unknown thickness of the recording medium based on the measured absolute variation of the width of the test line, a known encoder step width with respect to a thickness of a different recording medium, and a row pitch of the inkjet print head.

6. The method according to claim 5, wherein the modifying of the adjustment of the setup comprises entering the new encoder step width and/or entering a number of encoder steps corresponding to the row pitch of the inkjet print head.

7. The method according to claim 5, wherein the new encoder step width is calculated based on a difference of the known encoder step width and a quotient of the measured absolute variation of the width of the test line and a number of encoder steps, said number corresponding to the row pitch of the inkjet head.

8. The method according to claim 4, wherein the modifying comprises calculating a thickness of the recording medium based on the measured absolute variation of the width of the test line, an encoder step width with regard to a known thickness of another recording medium, and a line pitch of the inkjet print head.

9. The method according to claim 8, wherein the modifying of the adjustment of the setup includes setting of the thickness of the recording medium.

10. The method according to claim 8, wherein the thickness of the recording medium is calculated from a difference of the known thickness of the other recording medium, as a minuend, and a quotient, as a subtrahend, wherein the quotient is calculated from a product of the measured absolute variation of the width of the test line with a number of encoder steps corresponding to the full revolution of the encoder as a dividend, and a product of a number of cycle steps corresponding to the row pitch of the inkjet head, with pi as a divisor.

11. A non-transitory computer-readable storage medium with an executable program stored thereon, wherein, when executed, the program instructs a processor to perform the method of claim 1.

12. A printing system adapted to adjust a setup for an encoder for printing to a recording medium of unknown thickness, the printing system comprising:

a print head configured to print a continuous test line onto the recording medium transversal to a feed direction of the recording medium;

a sensor configured to measure a variation in a width of the test line; and controller configured to modify an adjustment of the setup, based on the measurement of the variation of the width, to minimize the variation of the width of the test line.

13. A method for adjusting a setup for an encoder for printing to a recording medium of unknown thickness with a multi-row inkjet print head in a printing system, the method comprising:

printing a test line onto the recording medium;

measuring a width of the test line; and adjusting the setup for the encoder, based on the measured width, to reduce the width of the test line.

14. The method according to claim 13, wherein the test line is transversal to a feed direction of the recording medium.

15. The method according to claim 13, wherein the method is iteratively performed until the width is no longer is reducable by the modifying operation.

* * * * *